US005409152A

United States Patent [19]

Trevino

[11] Patent Number: 5,409,152

[45] Date of Patent: Apr. 25, 1995

[54] BACKPACK ASSEMBLY WITH AUDIO COMPONENTS

[76] Inventor: Jose Trevino, 375 Media Luna, Apt. 606, Brownsville, Tex. 78521

[21] Appl. No.: 238,624

[22] Filed: May 5, 1994

[51] Int. Cl.[6] ..... A45F 4/02

[52] U.S. Cl. ..... 224/153; 224/209; 224/259; 224/902; 455/351

[58] Field of Search ..... 224/153, 209, 210, 211, 224/224, 236, 237, 259, 902, 32 R, 36; 361/422; 455/346, 347, 351

[56] References Cited

U.S. PATENT DOCUMENTS

| | | | |
|---|---|---|---|
| 2,503,847 | 4/1950 | Shanahan | 224/902 |
| 2,625,192 | 1/1953 | Kinskie | 224/902 |
| 2,676,738 | 4/1954 | Herrick | 224/902 |
| 4,084,139 | 4/1978 | Jakobe | 325/361 |
| 4,561,576 | 12/1985 | Lowe et al. | 224/209 |
| 4,589,134 | 5/1986 | Waldron | 381/90 |
| 4,664,646 | 9/1987 | Nesbit et al. | 455/351 |
| 4,744,398 | 5/1988 | Clark | 224/153 |
| 4,764,962 | 8/1988 | Ekman et al. | 381/24 |
| 4,785,984 | 11/1988 | Seitz-Gangemi | 224/259 |
| 4,817,191 | 3/1989 | Adams | 455/351 |
| 4,883,207 | 11/1989 | McArthur | 224/153 |
| 5,001,779 | 3/1991 | Eggert et al. | 455/351 |
| 5,004,105 | 4/1991 | Freadman | 455/346 |
| 5,211,321 | 5/1993 | Rodriguez | 224/902 |

*Primary Examiner*—Henry J. Recla
*Assistant Examiner*—Gregory M. Vidovich

[57] ABSTRACT

A backpack assembly for holding audio components comprising a backpack having lower, upper, front, rear and two side faces. One of the side faces includes a plurality of pockets formed interiorly of the bag. One of the plurality of the pockets is sized to hold a speaker therein and a second of the plurality of pockets is sized to hold a radio therein wherein the radio and the speaker are operatively connected by a speaker wire extending from the speaker to the radio.

2 Claims, 3 Drawing Sheets

FIG. 5
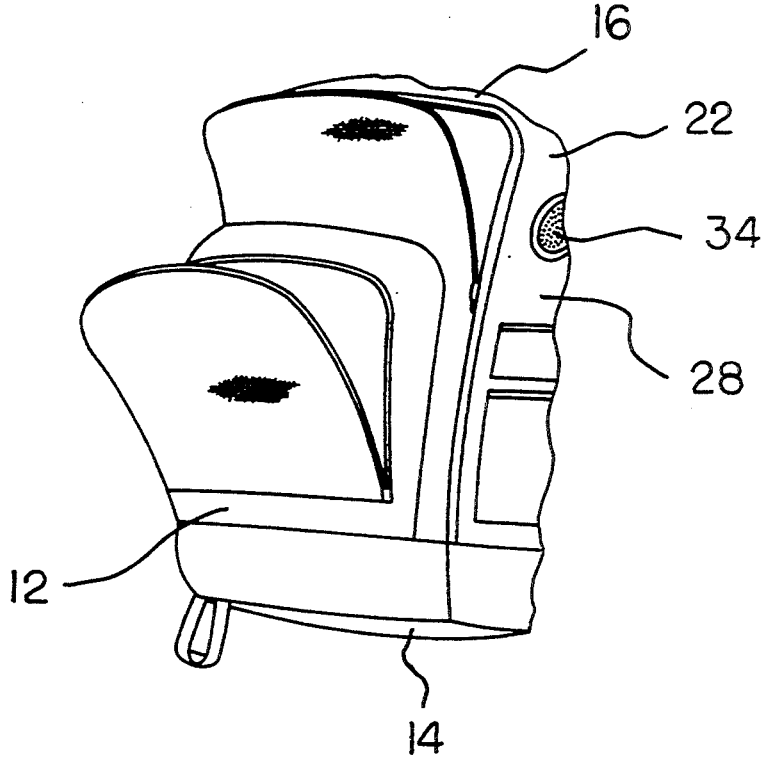
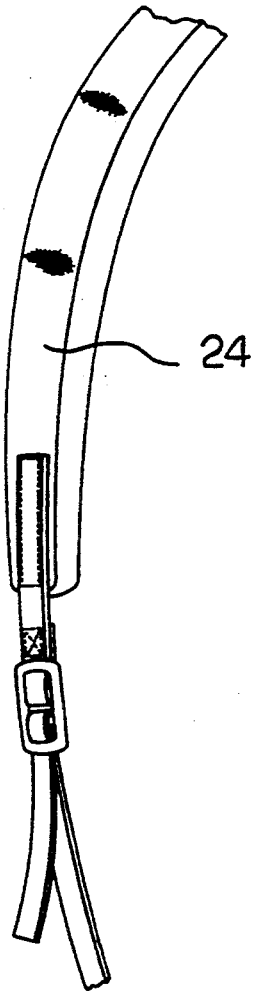
FIG. 6

BACKPACK ASSEMBLY WITH AUDIO COMPONENTS

BACKGROUND OF THE INVENTION

1. Field of the Invention

The present invention relates to a backpack assembly with audio components and more particularly pertains to generating sound through components in a backpack.

2. Description of the Prior Art

The use of backpacks and radios is known in the prior art. More specifically, backpacks and radios heretofore devised and utilized for the purpose of generating sound from radios in various devices are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 4,084,139 to Jakobe a shoulder supported stereophonic radio receiver.

U.S. Pat. No. 4,484,276 to Sata discloses a personal audio device.

U.S. Pat. No. 4,589,134 to Waldron discloses a personal sound system.

U.S. Pat. No. 4,764,962 to Eckman discloses a stereo speaker system for walkman-type radio and/or cassette player.

U.S. Pat. No. 4,785,984 to Seitz-Gangemi discloses an athletic radio holder.

In this respect, the backpack assembly with audio components according to the present invention substantially departs from the conventional concepts and designs of the prior art, and in doing so provides an apparatus primarily developed for the purpose of generating sound through components in a backpack.

Therefore, it can be appreciated that there exists a continuing need for new and improved backpack assemblies with audio components which can be used for generating sound through components in a backpack. In this regard, the present invention substantially fulfills this need.

SUMMARY OF THE INVENTION

In view of the foregoing disadvantages inherent in the known types of backpacks and radios now present in the prior art, the present invention provides an improved backpack assembly with audio components. As such, the general purpose of the present invention, which will be described subsequently in greater detail, is to provide a new and improved backpack assembly with audio components and method which has all the advantages of the prior art and none of the disadvantages.

To attain this, the present invention essentially comprises a new and improved backpack assembly with audio components comprising, in combination, a backpack having a container for the support of materials to be transported, the backpack having a lower face, an upper face, a front face, a rear face and side faces as well as shoulder straps for receipt by a user; a plurality of pockets formed in one of the side faces, the pockets including a first upper pocket having an aperture with a speaker secured therein, the aperture having a screen on its exterior surface for covering the speaker, a supplemental support sheet interior of the first pocket with an aperture adjacent to the lower end for the passage of a speaker wire, the upper end of the upper pocket being opened with an internal flap secured thereabove to the interior of the side wall and a downwardly extending edge removably couplable with the upper edge of the first pocket; a second lower pocket formed in the side wall beneath the first pocket, the second pocket having a height of about two times its width, the second pocket having an interior support sheet secured at its lower end to the backpack beneath the second pocket and having an upper opened end with an internal flap secured at its upper edge to the interior of the side wall above the second pocket and having a lower edge releasably secured to the upper edge of the second pocket, the second pocket having an exterior opening with a laterally disposed cross-piece therebetween with a first external flap secured at its upper end to the exterior surface of the backpack above the second pocket for exposing the battery region of a radio in the second pocket and a lower end releasably secured to the crosspiece and a second external flap secured to the cross piece and a lower end releasably secured to the exterior of the backpack beneath the second opening for providing access to the radio controls; and a radio located within the second pocket.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved backpack assemblies with audio components which have all the advantages of the prior art backpacks and radios and none of the disadvantages.

It is another object of the present invention to provide new and improved backpack assemblies with audio components which may be easily and efficiently manufactured and marketed.

It is further object of the present invention to provide new and improved backpack assemblies with audio components which are of durable and reliable constructions.

An even further object of the present invention is to provide new and improved backpack assemblies with audio components which are susceptible of a low cost of manufacture with regard to both materials and labor, and which accordingly are then susceptible of low prices of sale to the consuming public, thereby making such backpack assembly with audio components economically available to the buying public.

Still yet another object of the present invention is to provide a new and improved backpack assemblies with audio components which provide in the apparatuses and methods of the prior art some of the advantages thereof, while simultaneously overcoming some of the disadvantages normally associated therewith.

Still another object of the present invention is to generate sound through components in a backpack.

Lastly, it is an object of the present invention to provide new and improved backpack assembly with audio components comprising a backpack having a container for the support of materials to be transported, the backpack having a lower face, an upper face, a front face, a rear face and side faces; a plurality of pockets formed in one of the side faces, the pockets including a first upper pocket having an aperture with a speaker secured therein, a supplemental support sheet interior of the first pocket with an aperture adjacent to the lower end for the passage of a speaker wire, the upper end of the upper pocket being opened with an internal flap secured thereabove to the interior of the side wall and a downwardly extending edge removably couplable with the upper edge of the first pocket; and a second lower pocket formed in the side wall beneath the first pocket, the second pocket having an interior support sheet secured at its lower end to the backpack beneath the second pocket and having an upper opened end with an internal flap secured at its upper edge to the interior of the side wall above the second pocket and having a lower edge releasably secured to the upper edge of the second pocket, the second pocket having an exterior opening with a laterally disposed cross-piece therebetween with a first external flap secured at its upper end to the exterior surface of the backpack above the second pocket for exposing the battery region of a radio in the second pocket and a lower end releasably secured to the crosspiece and a second external flap secured to the cross piece and a lower end releasably secured to the exterior of the backpack beneath the second opening.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a perspective view of the improved backpack assembly illustrated in FIG. 1 showing the internal compartments of the backpack.

FIG. 6 is a perspective view of a shoulder strap of the backpack assembly.

The same reference numerals refer to the same parts through the various Figures.

DESCRIPTION OF THE PREFERRED EMBODIMENT

Figure 1:
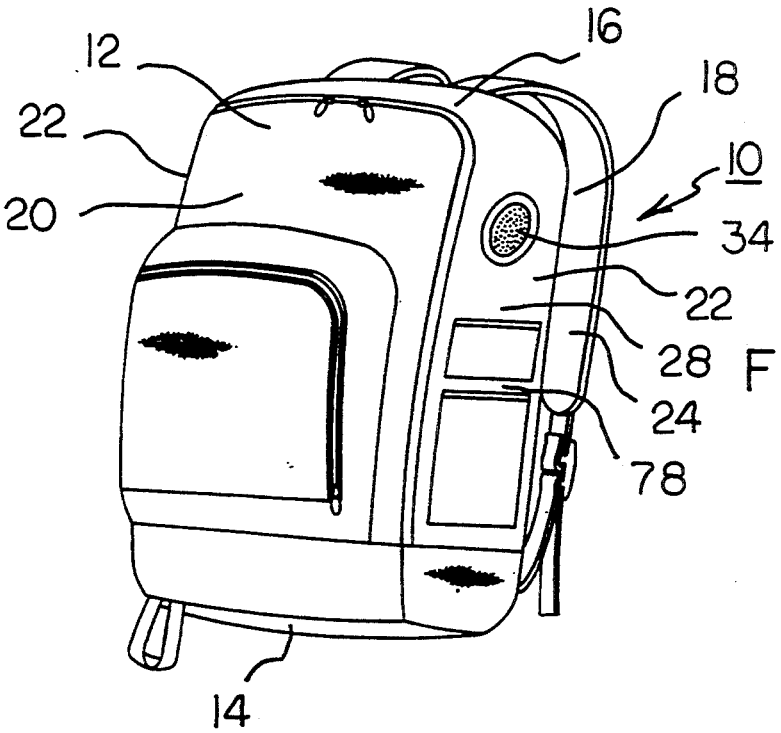
FIG. 1 is a perspective view of the preferred embodiment of the new and improved backpack assembly with audio components constructed in accordance with the principles of the present invention.
Figure 2:
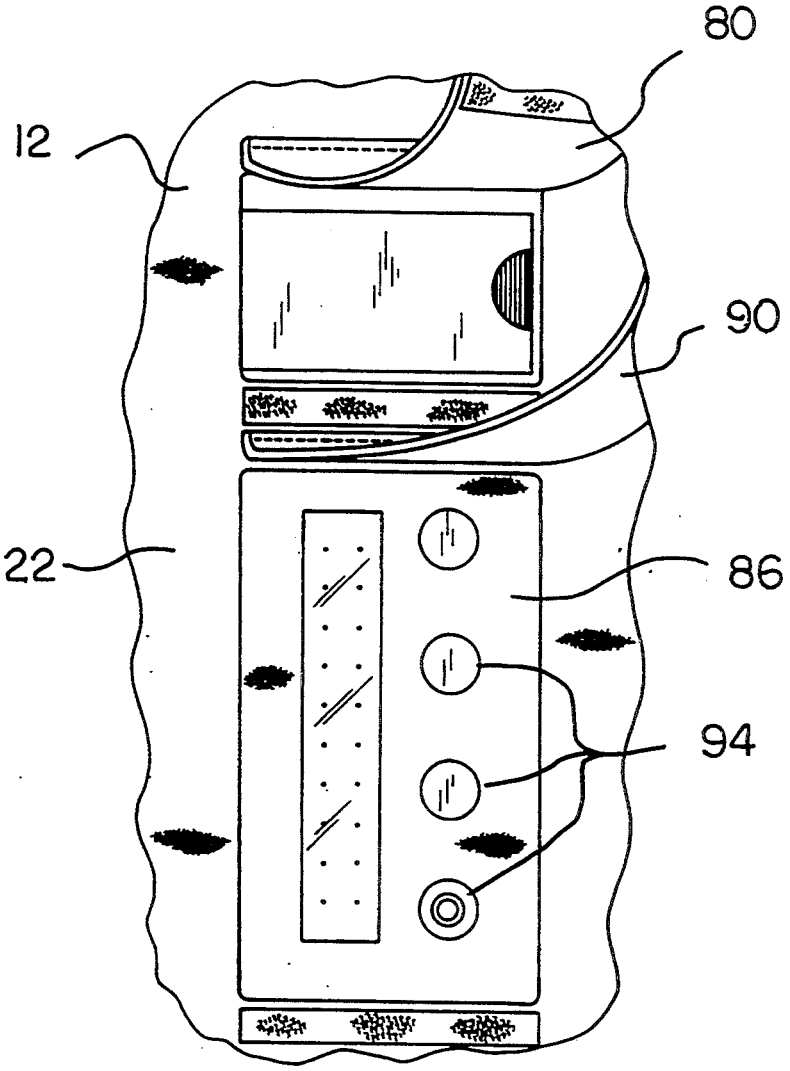
FIG. 2 is a perspective view of one side of the backpack of FIG. 1 with the flaps lifted.
Figure 3:
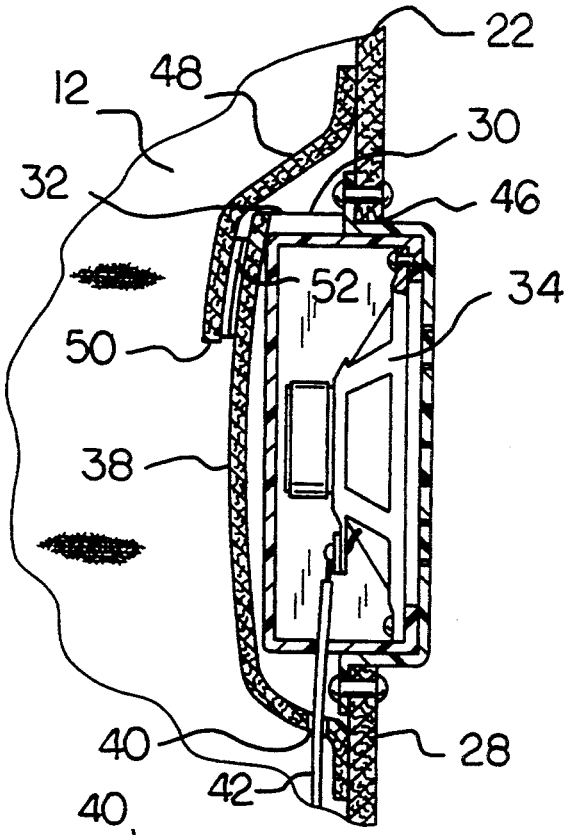
FIG. 3 is a cross-sectional view of the upper portion of the sound components of FIG. 2.
Figure 4:
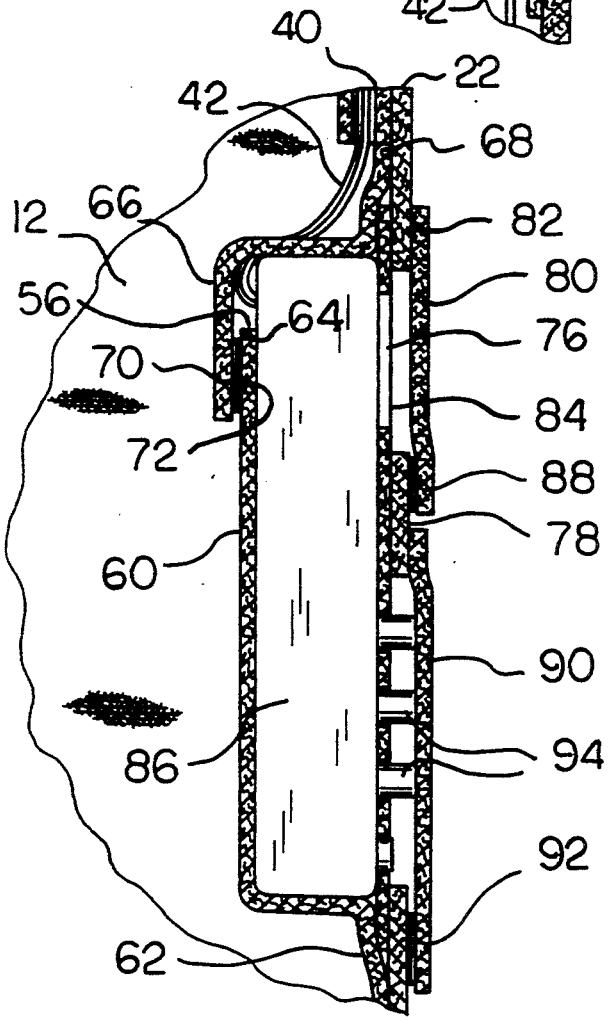
FIG. 4 is a cross-sectional view of the lower portion of the sound components of FIG. 2.

With reference now to the drawings, and in particular to FIG. 1 thereof, the preferred embodiment of the new and improved backpack assembly with audio components embodying the principles and concepts of the present invention and generally designated by the reference numeral 10 will be described.

The present invention, the new and improved backpack assembly with audio components, is comprised of a plurality of component elements. Such elements in their broadest context include a backpack, pockets including an upper pocket and a lower pocket and a radio within the lower pocket. Such components are specifically configured and correlated with respect to each other so as to attain the desired objective.

More specifically, the backpack assembly 10 has as its main component a backpack 12. Such backpack is a container for support of materials to be transported. The backpack includes a lower face 14, an upper face 16, a front face 18, a rear face 20 and side faces 22. The backpack also includes shoulder straps 24 for receipt by the arms of a user.

Within the backpack is a plurality of pockets. Such pockets are formed on one side face 28. Such pockets include a first upper pocket 30. Such upper pocket has an aperture 32. An audio speaker 34 is secured within the aperture. The aperture is also provided with a screen on its exterior surface for covering the speaker.

Within the first pocket is a supplemental support sheet 38. Such support sheet is interior of the first pocket. It has an aperture 40 adjacent to the lower end for the passage of a speaker wire 42. The upper end 44 of the upper pocket is formed with an opening 46. It also includes an internal flap 48 secured thereabove to the interior of the side wall. It also has a downwardly extending edge 50. Such edge is removably couplable with the upper edge 52 of the first pocket.

Next provided is a second or lower pocket 56. The second pocket is formed in the side wall beneath the first pocket. The second pocket has a height of about two times its width.

The second pocket has an interior support sheet 60. Such sheet is secured at its lower end 62 to the backpack beneath the second pocket. The support sheet also has an upper opening 64 with an internal flap 66 secured at its upper edge 68 to the interior of the side wall. Such securement is above the second pocket. The internal flap also has a lower edge 70 which is releasably secured to the upper edge 72 of the second pocket.

The second pocket has an exterior opening 76 with a laterally disposed crosspiece 78 therebetween. It also has a first external flap 80 secured at its upper end 82 to the exterior surface of the backpack above the second pocket. This functions for exposing the battery region 84 of the radio 86 located in the second pocket. The first external flap also has a lower end 88 secured to the crosspiece and a second external flap 90 secured to the crosspiece and a lower end 92 releasably secured to the exterior of the backpack beneath a second opening. This arrangement is for providing access to the radio controls 94.

The last component of the system is the radio located within the second pocket for providing the music to be played through the speaker, support being totally provided by the backpack at one side edge.

The present invention is an adaptation of products that already exist on the market. The present invention comprises a backpack which is used by students during the school year and campers which is used year round.

The products that adapt to the backpack may include a radio, cassette-player or compact disc. These articles are well-known and have different presentations according to quality, power, functions etc. When combining the backpack with its different presentations, the result is a new product that has a great market.

The present invention is a product consisting of a backpack that has a radio installed in the lower part of its right side and one speaker in each side on the upper part. The radio is installed through the inside of the backpack but all covered by a rubber cover, in such a way that when putting in—or taking out books or other things, the radio is not seen, touched or moved. On the outside, there are only three buttons (on/off volume, tuning and balance), the dial, and a plug for the headphones. These buttons are easily reached by reaching back when wearing the backpack. All this is covered by a flap that has a square of Velcro on its inner lower part, on the upper part of the flap, there will be a zipper which when opened, will show a hard plastic box that contains the batteries.

The speakers will have a two inch diameter which will be inserted through the inside of the backpack and covered with plastic so they will not be seen or moved. From the outside, the speakers will be seen as hard plastic circles with perforations. The connecting wires of the radio to the speakers will go inside and covered with plastic so they will not be seen.

This model can be made with low quality materials for the backpack and an AM radio so it can be sold for a low price. It can also be presented with high quality materials for the backpack and an AM/FM radio and be sold for a higher price in stores where higher quality products are sold.

This model has basically the same installation than the model with the radio, with the difference that what is being installed here is a cassette player. The flap on the side will cover the small door where the cassette goes, the keys and control knobs.

A great variety of products can be presented in this model, for example, backpack with cassette player, backpack with cassette player with an AM/FM radio, tape recorder and player with AM/FM radio, etc. They can also have different types of controls like an equalizer, sound balance on the speakers, tuning control, etc.

In some models the speakers can be rectangular and instead of going on the sides of the backpack, they will go on the two straps, so that when wearing the backpack, the speakers will end up close to the shoulders from the front.

In the model with a compact disc player, the compact disc player will be installed in the backpack for the higher price market.

In the model with the sound pack for the beach, a cassette player with an AM/FM radio or a compact disc can be installed. the material of this backpack will be of a neon-colored plastic of several different sizes, the purpose being for putting towels, combs, swimsuits, etc. in it. The side walls will be rigid to hold the sound system, but it may be given another position due to that in this model an additional protection is needed so that sand or water will not get in the cassette player or compact disc player.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved backpack assembly with audio components comprising, in combination:

a backpack having a container for the support of materials to be transported, the backpack having a lower face, an upper face, a front face, a rear face and side faces as well as shoulder straps connected thereto for receipt by a user;

a plurality of pockets formed in one of the side faces, the pockets including a first upper pocket having upper and lower ends and having an aperture formed within the side face with a speaker adapted to be secured within said first pocket, the aperture having a screen on the exterior surface of the side face for covering the speaker, said first pocket further comprising a supplemental support sheet secured to the interior of the backpack beneath the lower end of the first pocket having a wire aperture adjacent to a lower end of the sheet for the passage of a speaker wire extending from the speaker, the upper end of the upper pocket being opened with an internal flap secured above said upper end of said first pocket to the interior of the side face wherein said flap has a downwardly extending edge removably couplable with an upper edge of the sheet;

a second lower pocket having upper and lower ends formed in the side face beneath the first pocket, the second pocket adapted to hold a radio therein and having a height of about two times its width, the second pocket comprising a second supplemental support sheet secured to the interior of the backpack beneath the lower end of the second pocket, said second pocket further having an upper opened end with a second internal flap secured to the interior of the side face above the upper end of the the second pocket wherein said second internal flap of said second pocket has a lower edge releasably secured to an upper edge of the second sheet, the second pocket having an exterior opening with a laterally disposed cross-piece between an upper and lower end of said exterior opening and a first external flap secured above the upper end of said second pocket to the exterior surface of the backpack for exposing a battery region of the radio in the second pocket and a lower end of said first exterior flap releasably secured to the crosspiece and a second external flap secured to the cross piece and a lower end of said second exterior flap releasably secured to the exterior of the backpack beneath the lower end of the second pocket for providing access to radio controls of the radio.

2. The assembly set forth in claim 1 further including a speaker placed within said first pocket and a radio placed within said second pocket, said speaker having a speaker wire with a first end extending therefrom and through said wire aperture and a second end operatively connected to said radio.

* * * * *